US006736612B2

(12) United States Patent
Gibbons

(10) Patent No.: US 6,736,612 B2
(45) Date of Patent: May 18, 2004

(54) PUMP

(75) Inventor: Graham W. Gibbons, Kirkwall (GB)

(73) Assignee: Curtiss-Wright Flow Control Corporation, E. Farmingdale, NY (US)

( * ) Notice: Subject to any disclaimer, the term of this patent is extended or adjusted under 35 U.S.C. 154(b) by 0 days.

(21) Appl. No.: 09/900,611

(22) Filed: Jul. 6, 2001

(65) Prior Publication Data

US 2002/0051714 A1 May 2, 2002

Related U.S. Application Data

(63) Continuation of application No. PCT/GB00/00041, filed on Jan. 10, 2000.

(30) Foreign Application Priority Data

Jan. 8, 1999 (GB) ..... 9900286

(51) Int. Cl.[7] ..... F04B 17/00; F04B 35/00
(52) U.S. Cl. ..... 417/403; 91/55
(58) Field of Search ..... 417/403, 393, 417/375, 360, 342; 91/296, 306; 137/99

(56) References Cited

U.S. PATENT DOCUMENTS

| | | | | |
|---|---|---|---|---|
| 3,635,125 A | | 1/1972 | Rosen et al. | |
| 3,780,622 A | * | 12/1973 | Vogel | 91/296 |
| 4,682,937 A | | 7/1987 | Credle, Jr. | |
| 4,790,728 A | * | 12/1988 | Dwyer | 417/342 |
| 4,846,045 A | * | 7/1989 | Grach et al. | 91/306 |
| 4,867,653 A | * | 9/1989 | Miolls et al. | 417/360 |
| 5,238,372 A | * | 8/1993 | Morris | 417/393 |
| 5,349,895 A | | 9/1994 | Decarlo | |
| 5,366,353 A | * | 11/1994 | Hand | 417/375 |
| 5,454,395 A | * | 10/1995 | Rehfeld | 137/99 |
| 5,513,963 A | * | 5/1996 | Walton | 417/403 |
| 5,529,463 A | * | 6/1996 | Layer et al. | 417/403 |
| 5,615,967 A | * | 4/1997 | Hellon | 403/133 |
| 5,795,092 A | * | 8/1998 | Jaworski et al. | 403/56 |
| 6,079,959 A | * | 6/2000 | Kingsford et al. | 417/393 |
| 6,206,604 B1 | * | 3/2001 | Dembowsky et al. | 403/135 |
| 6,398,446 B1 | * | 6/2002 | Pazdirek et al. | 403/134 |

FOREIGN PATENT DOCUMENTS

DE 2915096 A 10/1980

OTHER PUBLICATIONS

International Search Report, Nov. 8, 2000.
International Preliminary Examination Report, Mar. 29, 2001.

* cited by examiner

*Primary Examiner*—Sang Y. Paik
*Assistant Examiner*—Leonid M Fastovsky
(74) *Attorney, Agent, or Firm*—Pearne & Gordon LLP

(57) ABSTRACT

A pump including a reciprocating piston movable in a piston chamber by pneumatic pressure. The pneumatic pressure is directed through air channels by one or more valves. At least one of the valves and/or air channels is located in a removable portion of the pump.

17 Claims, 11 Drawing Sheets

Z-Z

Y-Y

X-X

T-T

W-W

X-X

V-V

Y-Y

Z-Z 24
24b
T
V
W
X
Y
Z

X-X

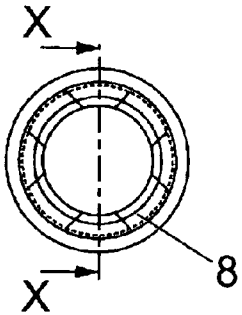
Fig. 23
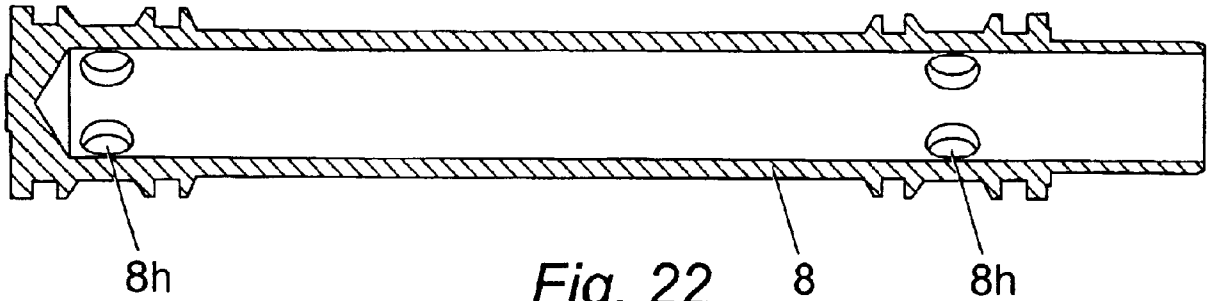
Fig. 22
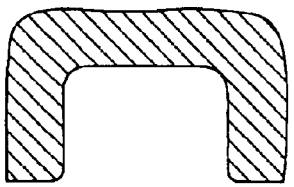
X-X

PUMP

The present invention relates to a pump.

Air pumps are known for the purpose of generating high-pressure flow in liquids and gases by pneumatically generated reciprocal movements of a piston. Such pumps generally require large numbers of components, and are difficult and expensive to service and maintain.

According to the present invention there is provided a pump comprising a reciprocating piston moved in a piston chamber by pneumatic pressure, the pneumatic pressure being directed through suitable channels by one or more valves, at least one of the valves and/or channels being located in a removable portion of the pump.

The or each valve and the or each channel is preferably located in a single block which may be moulded from plastics materials to define the channels and/or locations for valves in the moulded body. The block may be attached to the body of the pump by one or more removable attachment members which can, for instance, comprise rods which extend into semi-circular indentations provided on the block and body of the pump respectively, and which are aligned in use so as to define a generally circular channel for receiving the rod. Axial passage of the rod through the channels prevents, in certain embodiments, separation and/or movement out of alignment of the semi-circular indentations on the block and the body respectively. The rods can easily be removed by pulling them axially from the channels, and the block can simply be removed by hand from the body.

The invention also provides a connector portion for attachment of a mating connector portion to a body, the connector portion being captive on the body but being rotatable thereon to enable connection of the two portions without torque being applied to the body. The body is typically of plastics material, and the connector portion can be captive thereon by means of a flange.

The connector portion of the invention can typically be a socket or similar such female connector portion for connection to a mating male member. The connector portion and mating connector portions generally have screw threads to enable interconnection of the two portions.

The connector portion of the invention can typically be sealed to the housing by means of O-rings or similar such pressure seals.

An embodiment of the present invention will now be described by way of an example, and with reference to the accompanying drawings, in which:

FIG. 22 is a side view of a spool movable in the spool sleeve of FIG. 20;

FIG. 23 is an end view of the spool of FIG. 22;

Figure 1:
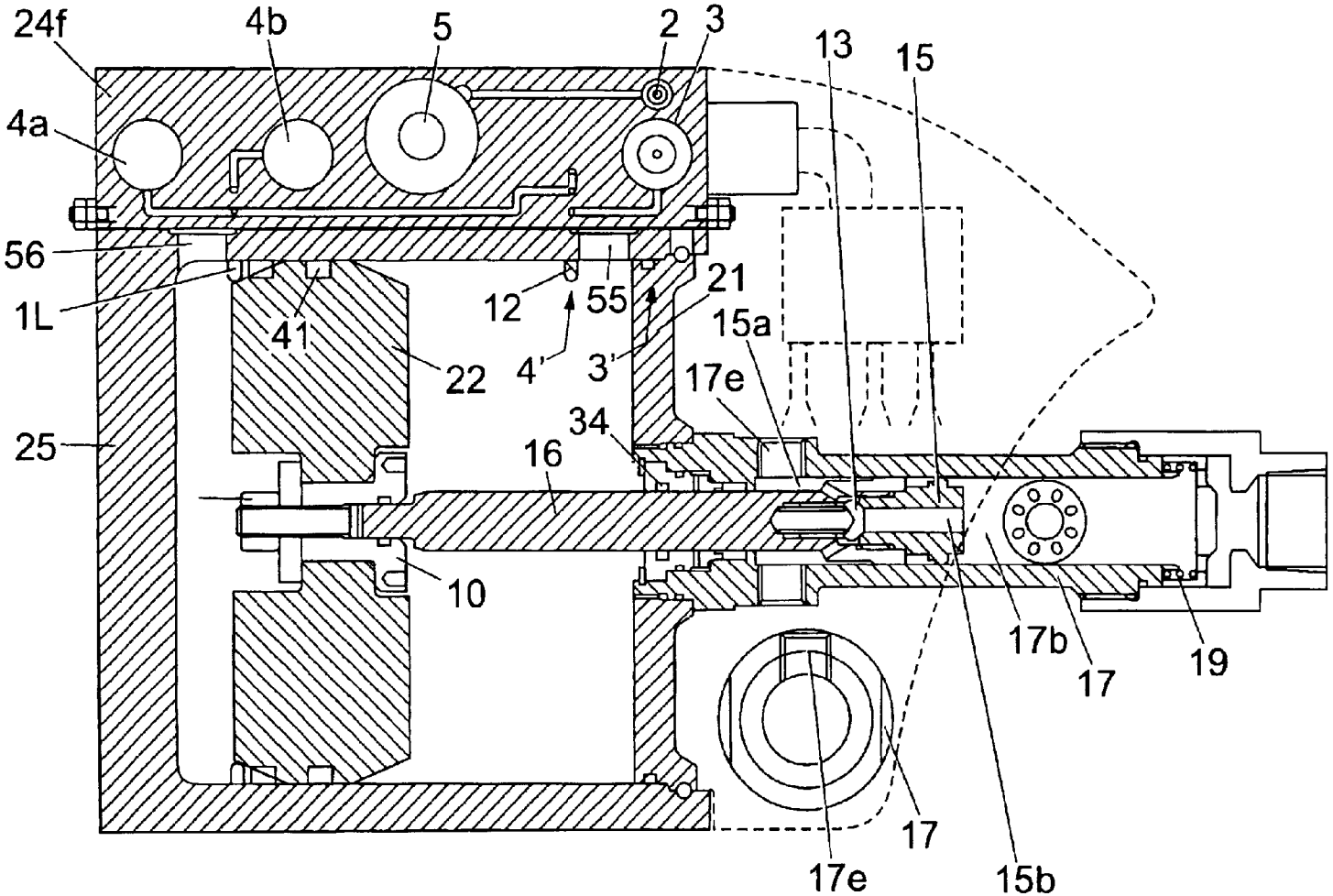
FIG. 1 is a side view of a pump according to the present invention.

Referring now to the drawings, an air pump has an air cylinder 25 (FIG. 2) having a cylindrical bore 25*b* in which a movable piston 22 (FIG. 1) is sealed by an O-ring 41. The piston is a two piece, ultrasonically welded design that "floats" on the boss 10, thus removing conventional problems with concentricity tolerances between the low pressure and high pressure ends, resulting in more uniform seal wear. The air cylinder 25 has an end plate 21 with a central bore to accommodate an O-ring—sealed piston shaft 16 from the air piston 22. The piston shaft 16 terminates in a head 15 adapted for high pressure pumping of hydraulic fluid.

Figure 3:
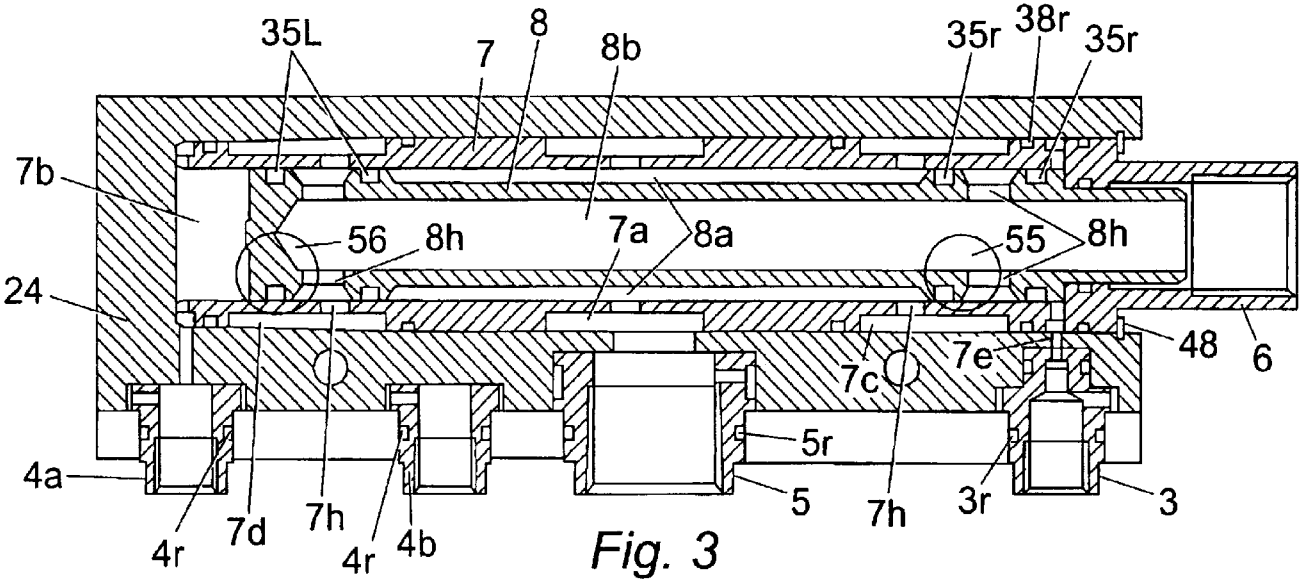
FIG. 3 is a plan view of a valve block of the FIG. 1 and FIG. 2 pumps.
Figure 5:
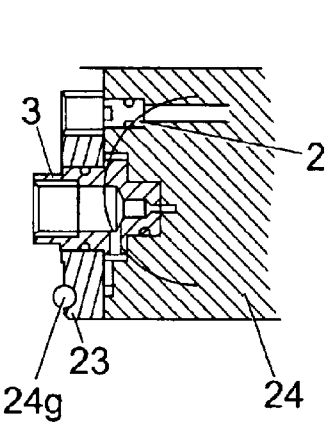
FIG. 5 is a partial view of a section through the FIG. 3 valve block at line 3' in FIG. 1.

The top surface 25*t* has a bed to receive a housing 24 for a valve assembly (FIG. 3). The valve housing 24 houses substantially all of the valves that are necessary to control airflow into the air cylinder 25, by valve means to be described, so that the movement of the piston 22 by the pneumatic pressure in the air cylinder 25 causes hydraulic pressure changes in the hydraulic fluid at the piston head 15. However, some low maintenance valves may be incorporated in the pump but outwith the housing 24.

Figure 20:
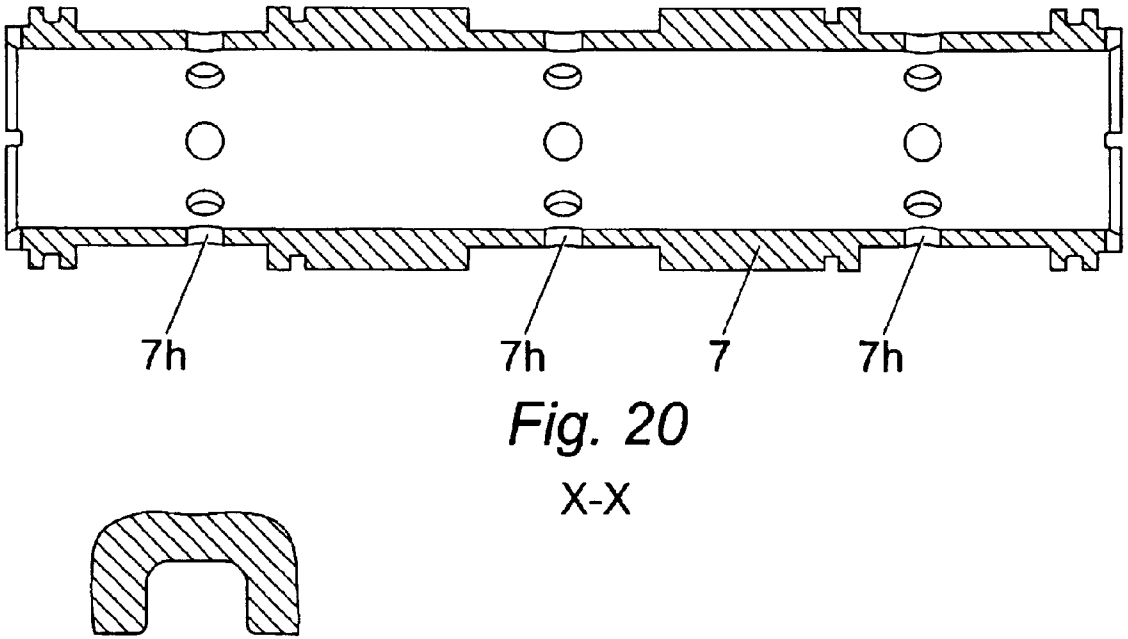
FIG. 20 is a side view of a spool sleeve of the FIG. 3 valve block.
Figure 25:
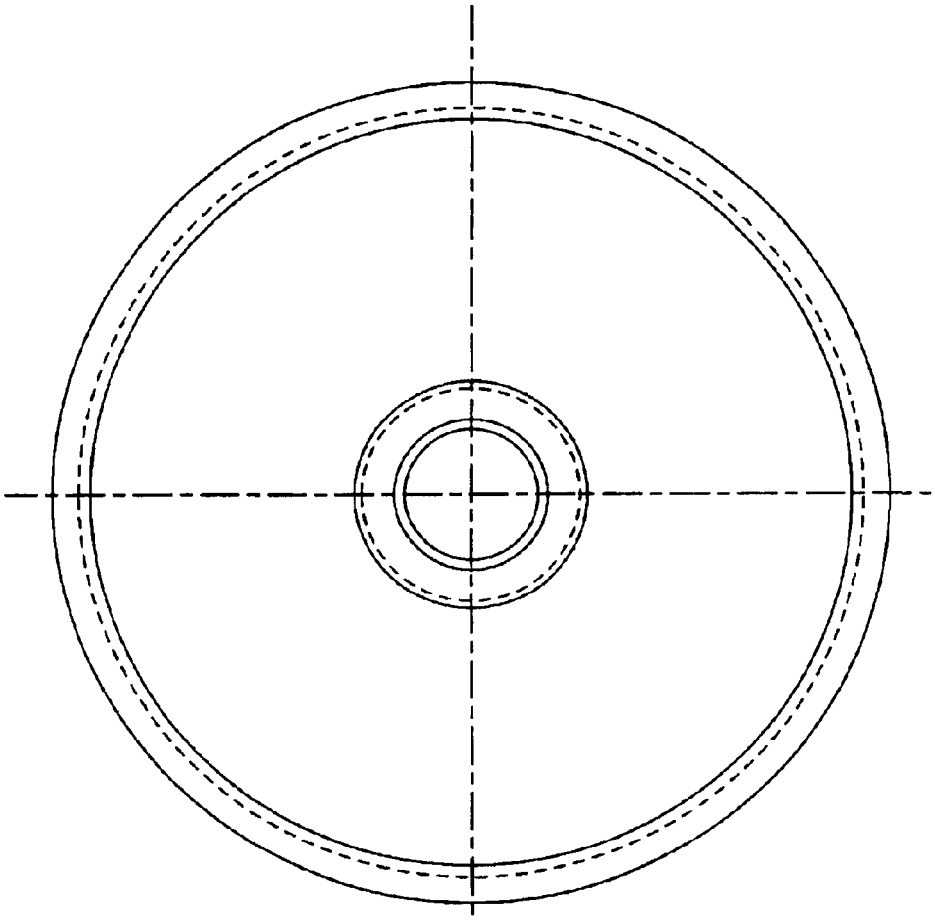
FIG. 25 is an end view of the FIG. 24 air piston.
Figure 24:
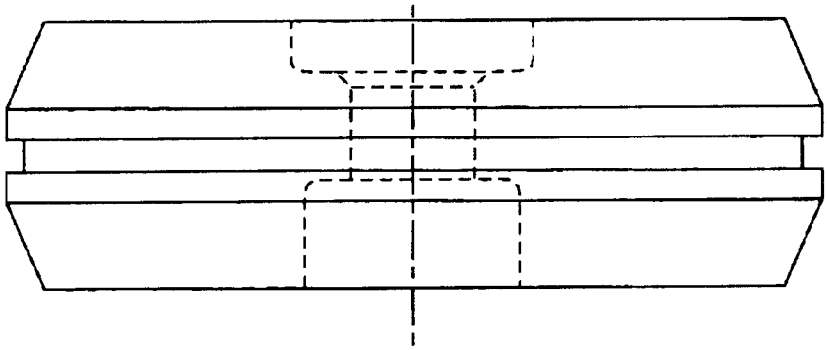
FIG. 24 is a side view of an air piston of the FIG. 1 pump.

A valve assembly (FIG. 3) has a housing 24 with a central bore 24*b* containing a spool sleeve 7 (FIG. 20) which is immovably sealed therein by O-rings and a circlip 48. The circlip and exhaust port 6 are optional. Further embodiments can incorporate an exhaust cowling which dips onto 21 (or 25). This cowling can contain acoustic damping materials to quieten the pump exhaust, and the outflow to the atmosphere can direct the very cold exhaust air over the warm high pressure cylinder to help extend the life of the high pressure seals. The spool sleeve 7 abuts an exhaust port 6 also retained by the circlip 48 and extending out of an open end of the bore 24*b* of the housing 24. The housing bore 24*b* is blind ended at the opposite end to the exhaust port 6. The spool sleeve 7 has a central bore 7*b* which receives a spool 8 (FIG. 22). The spool 8 is sealed to the spool sleeve by O-rings 35, and is slidable in the bore 7*b*, but retained therein by exhaust valve 6 held in by circlip 48. The spool 8 has a blind ended bore 8*b* which is open at the end adjacent the exhaust port 6, and sealed at the opposite end. An annulus 8*a* is defined between the spool 8 and the spool sleeve 7, and O-rings 35 seal off the annulus 8*a* at various points. The spool 8 has holes 8*h* which allow passage of air from the annulus 8*a* to the bore 8*b*.

Figure 28:
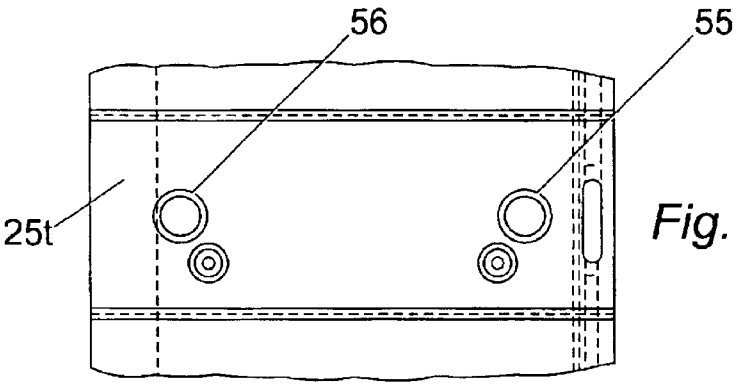
FIG. 28 is a plan view of a valve block bed of the FIG. 26 air cylinder.
Figure 27:
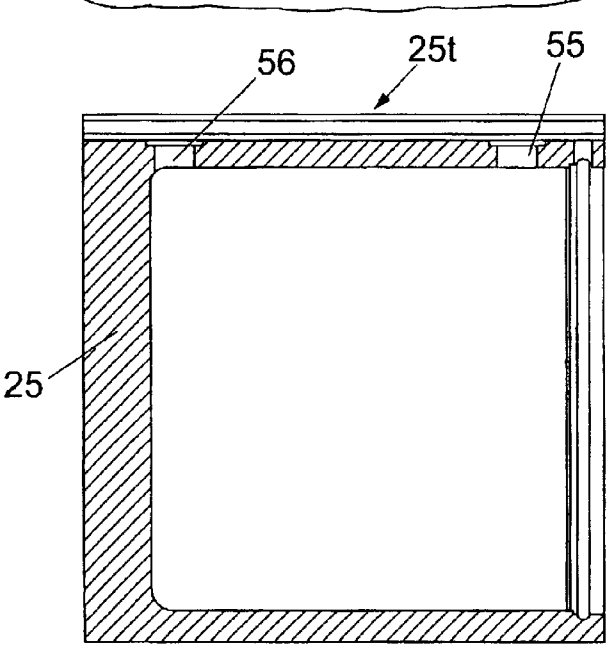
FIG. 27 is a section view through line XX of FIG. 26.
Figure 26:
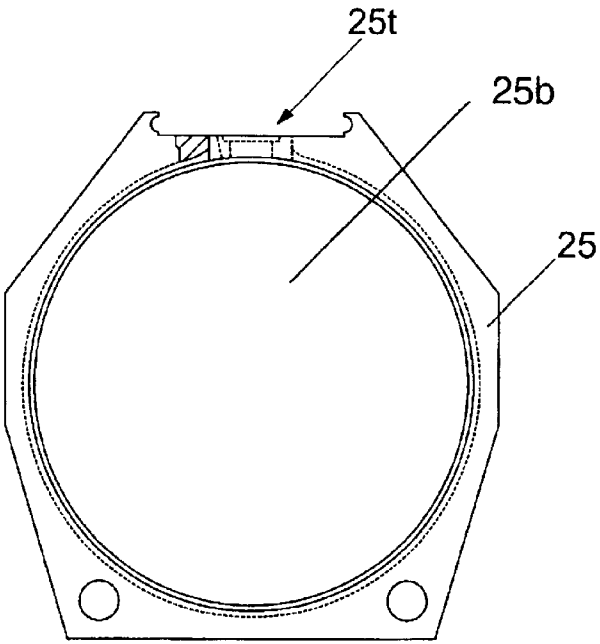
FIG. 26 is an end view of an air cylinder of the FIG. 1 pump.
Figure 29:
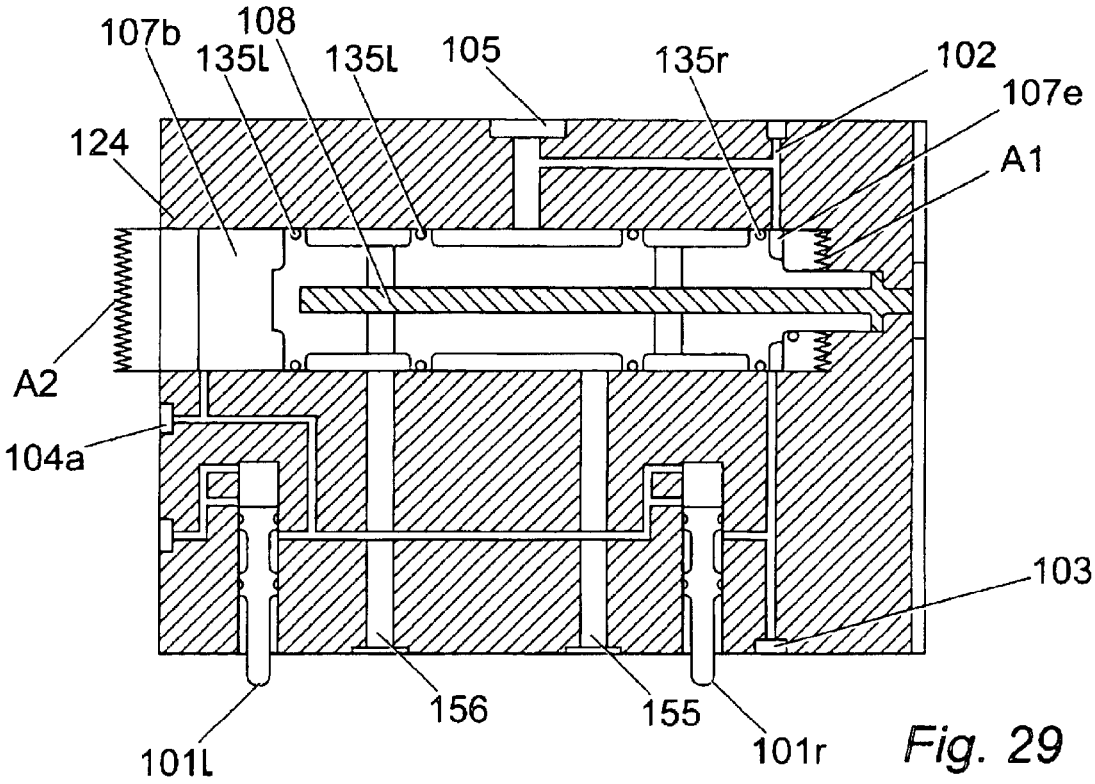
FIGS. 29 to 32 show a second embodiment of a valve block.

The valve housing 24 has an inlet 5 through which drive air passes from a source of pressurised air such as a compressor or compressed air cylinder. The drive air passes through the inlet 5 into the annulus 7*a* between the bore 24*b* and the spool sleeve 7, and from there through holes 7*h* in the spool sleeve 7 into the annulus 8*a* between the spool sleeve 7 and the spool 8. When the spool 8 is in the position shown in FIG. 3, the O-rings 35 permit the pressurisation of the annulus 7*c* on the right hand side of the valve through the right hand aperture 7*h* uncovered by the O-rings 35*r*. The annulus 7*c* is in communication with air hole 55 (FIG. 28) in the top surface 25*t* of the air cylinder 25, allowing pressurisation of the bore of the cylinder 25*b* on the right hand side of the piston 22. This pushes the piston 22 towards the closed end of the cylinder 25 (to the left in FIG. 1) and exhausts the air in that part of the bore 25*b* through air hole 56 in the top surface 25*t* on the other side of the piston 22. Air hole 56 is in communication with annulus 7*d* at the left hand end of the spool sleeve 7, which, through the left hand hole 7*h* aperture covered by O-rings 35*l* on the spool 8 enables pressure to escape into the bore 8*b* of the spool 8 and from there via the exhaust port 6 to the exhaust cowling.

Figure 2:
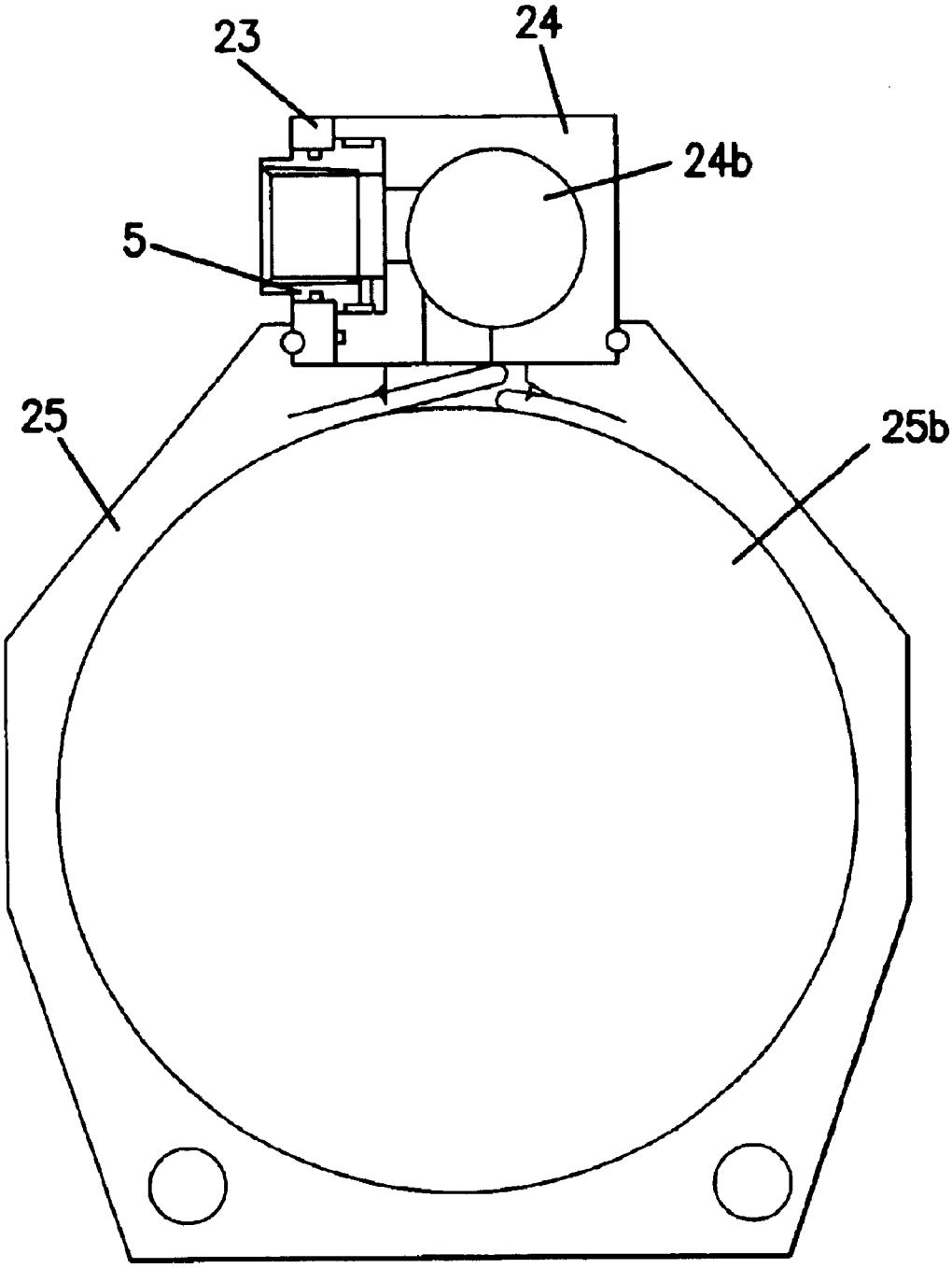
FIG. 2 is an end view of the FIG. 1 pump.

When the spool 8 moves from the right hand end of the spool sleeve 7 to the left hand end until it abuts against the wall of the housing 24, the hole 7*h* into annulus 7*c* is covered by O-rings 35*r*, and the drive air entering through inlet 5 can only pass through the left hand uncovered hole 7*h* into annulus 7*d*, and thereafter into the bore 25*b* on the left hand side of the piston 22 through air hole 56. Pressure increase on the left hand side of the piston 22 pushes the piston from left to right as shown in FIG. 1, allowing the air on the right hand side of the piston 22 in the cylinder bore 25*b* to exhaust through air hole 55, annulus 7*c* and through right hand holes 7*h* and 8*h* covered by O-rings 35 and into the bore 8*b* of the spool and from there via the exhaust port 6 to the exhaust cowling.

A system of poppet valves and air channels is provided in the housing 24 in order to switch the direction of the drive air passing through inlet 5 and for diverting it to either of air holes 56 or 55, as the case may be. A bleed line leads from the inlet 5 to a low-pressure port 2 in addition to leading to annulus 7*e*. The low-pressure port 2 is connected to the annulus 7*e* at the exhaust end of the bore 24*b*, which communicates via bore 24*b* with a pilot port 3. A bleed line leads from pilot port 3 to poppet valve 1*r* which, when open, connects the bleed line from the pilot port 3 to a bleed line to a single stroke port 4*a* at the other end of the housing 24. The single stroke port 4*a* bleeds pressure into the bore 7*b* of the spool sleeve 7 behind O-rings 35*l*, and the pressure in that portion of the bore 7*b* forces the spool 8 towards the exhaust port 6.

Figure 4:
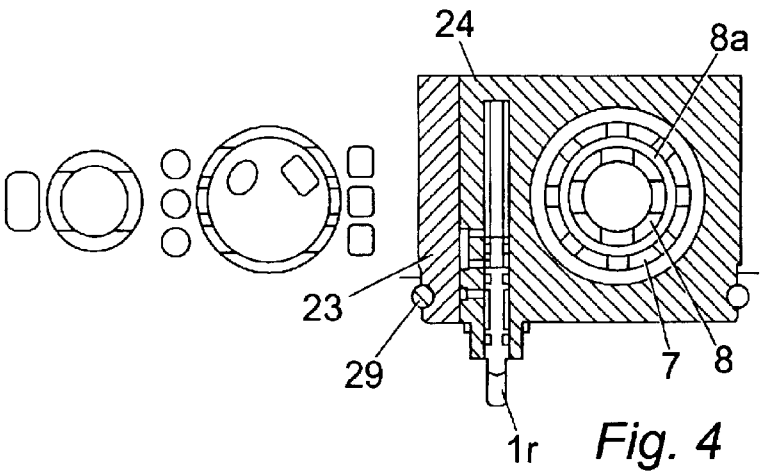
FIG. 4 is a section through the FIG. 3 valve block through line 4' in FIG. 1.
Figure 7:
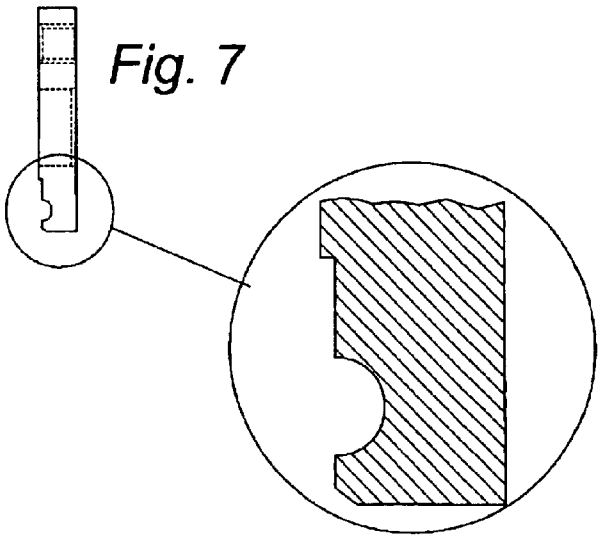
FIG. 7 is an end view of the FIG. 6 face.
Figure 6:
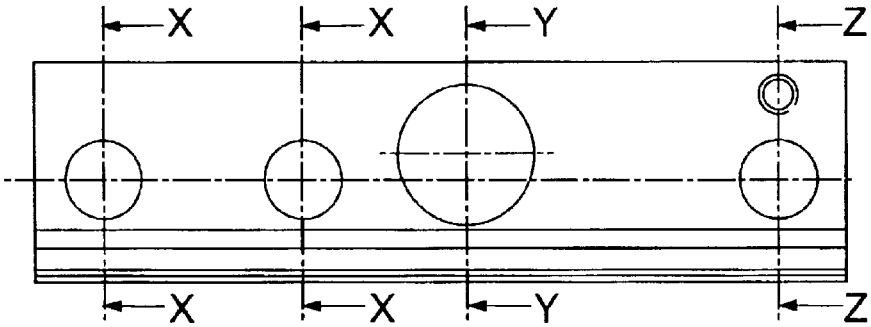
FIG. 6 is a face view of a plate on the FIG. 3 valve block.
Figure 10:
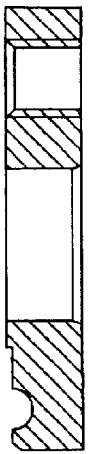
FIGS. 8, 9 and 10 are sections through the FIG. 6 face.
Figure 9:
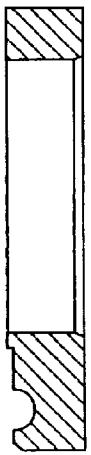
Figure 8:
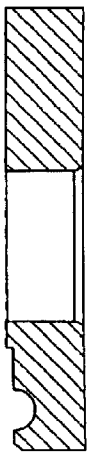
Figures 11, 12, 13, 14, 15, 16, 17, 18, 19:
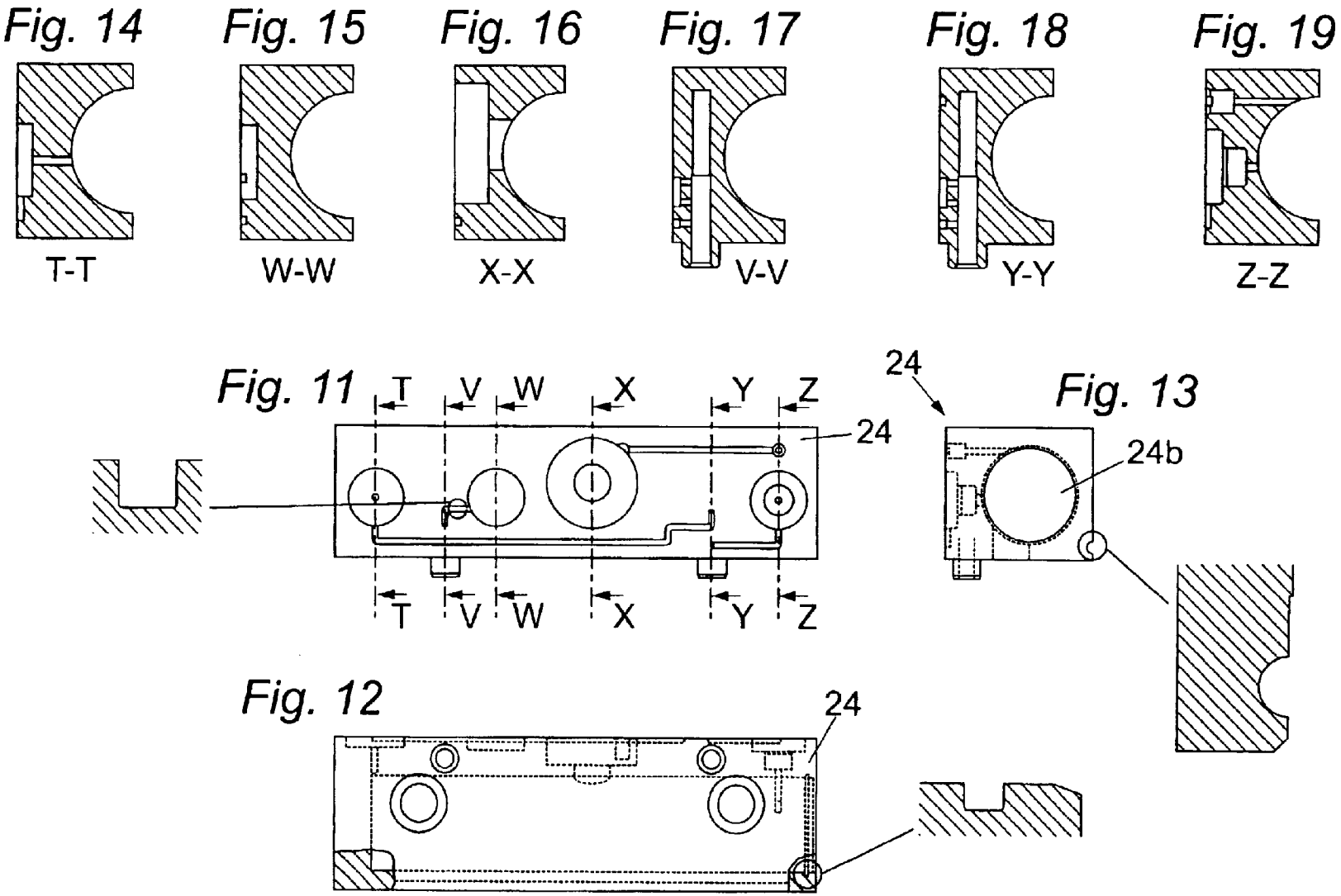
FIG. 11 is a side view of the valve block of FIG. 3.
FIG. 12 is a view from beneath the FIG. 11 valve block.
FIG. 13 is an end view of the FIG. 11 valve block.
FIGS. 14 to 19 are section views through the FIG. 11 valve block.
Figure 21:
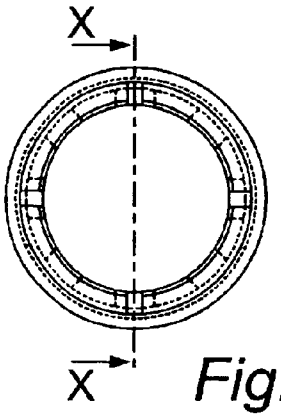
FIG. 21 is an end view of the FIG. 20 spool sleeve.

The pressure on the left hand end of the spool 8 in the bore 7*b* is constantly maintained by continuous bleed through the bleed lines, low pressure port, pilot port and single stroke port. When the poppet valve 1*r* is closed (ie in the down position shown in FIG. 4) the pressure is maintained in the single stroke port 4*a* and bore 7*b* to the left of the spool 8 thereby keeping the spool 8 forced against the exhaust port 6. In that configuration the drive air 5 is routed via the annulus 8*a* and 7*c* through to the right hand side of the piston 22 causing it to move to the left. As the piston 22 moves to the left hand blind end of the bore 25*b* of the cylinder 25, the right hand poppet valve 1*r* closes causing the pressure to be maintained behind the left hand end of the spool 8. As the piston 22 continues to move towards the left in the cylinder 25, it engages the stem of the left hand poppet valve 1*l*, thereby linking the bleed line from the single stroke port 4*a* to the bleed line to a pilot exhaust port 4*b*. The air trapped in bore 7*b*, single stroke port 4*a* and bleed lines escapes to the atmosphere through 4*b*.

When the pressure on the left hand side of the spool 8 is released, the pressure bled from the drive air 5 via the bleed line and low pressure port 2 and the force it generates on the right hand side of O-rings 35*r* will no longer be overcome by the pressure behind the left hand O-ring 35*l* of the spool, and this forces the spool 8 from the position shown in FIG. 3 to the left of the housing 24 so that the closed end of the spool 8 will abut eventually against the closed end of the bore 24*b* of the housing 24. At that point, the O-rings 35*r* will cover the hole 7*h* to annulus 7*c*, and the O-rings 35*l* will uncover the hole 7*h* to annulus 7*d*, and this causes the drive air entering the inlet 5 to be diverted in the annulus 8*a* through the aperture 7*h* to annulus 7*d*, and from there to the left hand side of the piston 22 through air hole 56. This causes the air pressure on the left-hand side of the piston 22 to increase, moving the piston 22 towards the right of the cylinder in FIG. 1 until it trips the stem of the right hand poppet valve 1*r*. Before it does so, it should be noted that the right hand poppet valve is closed, denying pressure transmission from the low pressure port 2, annulus 7*e* and pilot port 3 to the single stroke port 4*a*, so that the pressure differential generated by the pressure in annulus 7*c* favours the maintenance of the spool 8 against the closed end of the bore 24*b* (ie to the left in FIG. 3). However, when the piston 22 engages the stem of the right hand poppet valve 1*r*, the stem rises thereby linking the bleed lines between pilot port 3 and single stroke port 4*a* and transmitting the pressure from the drive air 5 through bleed lines, low pressure port 2, annulus 7*e*, pilot port 3, single stroke port 4*a*, and into the bore 7*b* behind the O-rings 35*l*. The pressure increase behind the O-rings 35*l* acts on a greater surface area than the pressure in annulus 7*e* behind O-rings 35*r*, and with the equalisation in pressure caused by opening of the poppet valve 1*r*, the extra area behind O-rings 35*l* causes the spool 8 to move to the right back to the configuration shown in FIG. 3. At that point, the drive air is once again directed from the inlet 5 through annulus 8*a* to the right through the aperture to annulus 7*c* which is uncovered by the O-rings 35*r*. The pressure can then be transmitted from annulus 7*c* through air hole 55 and to the right hand side of the piston 22, causing it to move to the left as initially described. The system will then cycle as described indefinitely while the pressure is applied through the inlet 5.

The cycling of the piston 22 in the cylinder 25 moves the shaft 16 and head 15. Movement of the head 15 in the hydraulic cylinder 17 from left to right as shown in FIG. 1 causes fluid in the cylinder 17 to be expelled from the bore 17*b* of the cylinder in front of the piston head 15, through bore 15*b* into annulus 15*a*. The volume of fluid in 17*b* is double that of volume 17*a*, therefore half of volume 17*b* is discharged through pressure port 17*e*. During this expulsion no fluid can escape through inlet check valve 19. Expulsion of the fluid in front of the head 15 from the bore 17*b* continues until the piston 22 and the shaft 16 have moved all the way to the right as shown in FIG. 1 and have reached the limit of their travel in the cylinders 25 and 17. At that point, all the fluid will have been expelled from the bore 17*b* in front of the piston head 15, and half the quantity of fluid will have accumulated in the annulus 15*a*. In order to accumulate in the annulus 15*a*, fluid passing through bore 15*b* has to pass a check valve in channel 13. On its return stroke from right to left, the high pressure seal on head 15 causes suction pressure in 17*b*, which opens check valve 19 and allows fluid to fill the bore 17*b* and it also expels the fluid accumulated in annulus 15*a* through pressure port 17*e*, denying its return passage through the check valve in channel 13. The pressure port 17*e* can be connected to the hydraulic fluid to be pressurised, and therefore the air pump of the invention can also act in its return stroke as well as in its forward stroke, ie double-acting.

The end plate 21 is held onto the cylinder block 25 by means of a flexible rod 12 which extends into a circular channel formed by semi-circular grooves which are located in the outer circumference of the end plate 21 and the inner circumference of the cylinder block 25, and when aligned, create the circular channel. The flexible rod 12 when located in the channel prevents relative movement of the end plate 21 and the cylinder block 25.

The valve housing 24 has similar semi-circular grooves 24*g* along its longitudinal edges at the base, and matching longitudinal grooves are provided in the side walls of the valve bed at the top surface 25*t*. Rods 9 secure the valve housing 24 to the cylinder block 25 in a similar manner. The rods 9 and 12 can be removed from the pump simply by pulling them, allowing the entire assembly to be stripped down very quickly and without the use of tools.

The ports 3, 4 and 5 are connectable to external air supplies by means of conventional screw in connectors. In certain embodiments of the invention, where the body 24 is moulded from a plastics material, it can be undesirable to screw in metal connectors to the plastic body, since the threads on the plastic portion can often damage easily by use of metal connectors. In certain variants, the connectors 3, 4 and 5 can comprise metal inserts sealed to the body by O-rings at 3*r*, 4*r* and 5*r* and are held captive on the housing by inner flanges which are wider than the apertures in the housing through which the connectors extend. This can be achieved by welding the plate 23 to the body 24 ultrasonically. The housing for the connectors can comprise normal metal such as steel or aluminium, which for their structural attachment to the housing 24, rely on the wider flanges on the inner edge of the apertures in which they are located. Since they are sealed by O-rings 3*r*, 4*r*, 5*r*, they can be free to rotate in the apertures, allowing them to be held therein without the use of screw attachments. This has the advantage that spanner heads etc can be applied to the outer surface of the connectors 3, 4 and 5 allowing them to be connected to conventional air hose attachments of metal and for the connections between those two items to be tightened by the use of spanners without harming any plastic moulded threads or other parts of the pump.

A further preferred feature of the invention comprises routing the cold exhausted air from exhaust port 6 through components of the hydraulic end of the pump, which are commonly at a high temperature. In addition, exhaust port 17*e* and/or the hydraulic lines which will be operating at high temperature can also be routed around the exhaust port 6 and other portions of the exhaust system to prevent freezing.

Embodiments of the present invention allow the production of simpler pumps with fewer individual components which are more easy to strip down and service. In addition, the double acting pumps can provide ratios from 10:1 to 225:1. Further embodiments of the invention obviate the need for external pipework which can be complex to maintain, prone to failure, and inefficient. In particular, it is possible in certain embodiments of the invention to provide the spool, spool sleeve and/or housing 24 as a throw-away module which can be simply replaced by stripping out the rods 9 and replacing a faulty housing with a new one.

A further embodiment of the invention is shown in FIGS. 29 to 32, which show schematically a second embodiment of a valve housing with similar features which will be described with reference to the same numerals as previously described, but with 100 added. Housing 124 has a bore with channel to air holes 156 and 155, a spool 108 and a poppet valve system 101 as previously described. In its normal operation (FIG. 29), the air inlet 105 bleeds air through bleed line to a low pressure port 102 to an annulus 107*e* behind an O-ring 135*r* on the spool 108. The pressure is transmitted from annulus 107*e* through bleed lines to a pilot port 103 and from there to a poppet valve 101*r* which in the down and closed configuration prevents pressurisation of the system beyond the bleed line to the pilot port 103. However, when the poppet valve 101*r* is up and open, the bleed line from the pilot port 103 is connected to a bleed line to a single stroke port 104*a* and from there to an area of the bore 107*b* behind O-rings 135*l*. The pressure A1 in the annulus 7*e* is only ever overcome by the pressure A2 in the bore 107*b* behind the O-rings 135*l* when the right hand side poppet valve 103*r* is in the up position and the bleed lines between the pilot port 103 and the single stroke port 104*a* are open.

Figure 30:
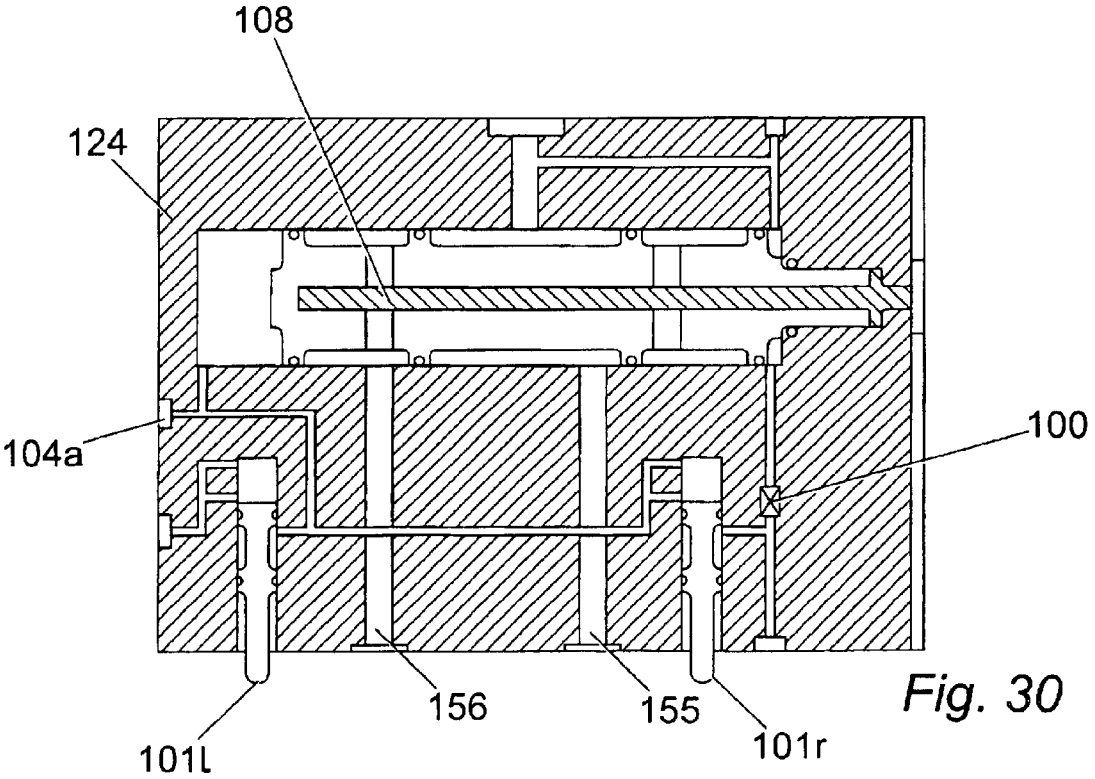

In one modified embodiment shown in FIG. 30, an additional grub screw 100 is provided in the pilot port which allows the use of an external air supply to drive the spool 108 to the right of FIG. 30. This allows a small ⅛$^{th}$" line to be used as a remote start/stop signal line.

Figure 31:
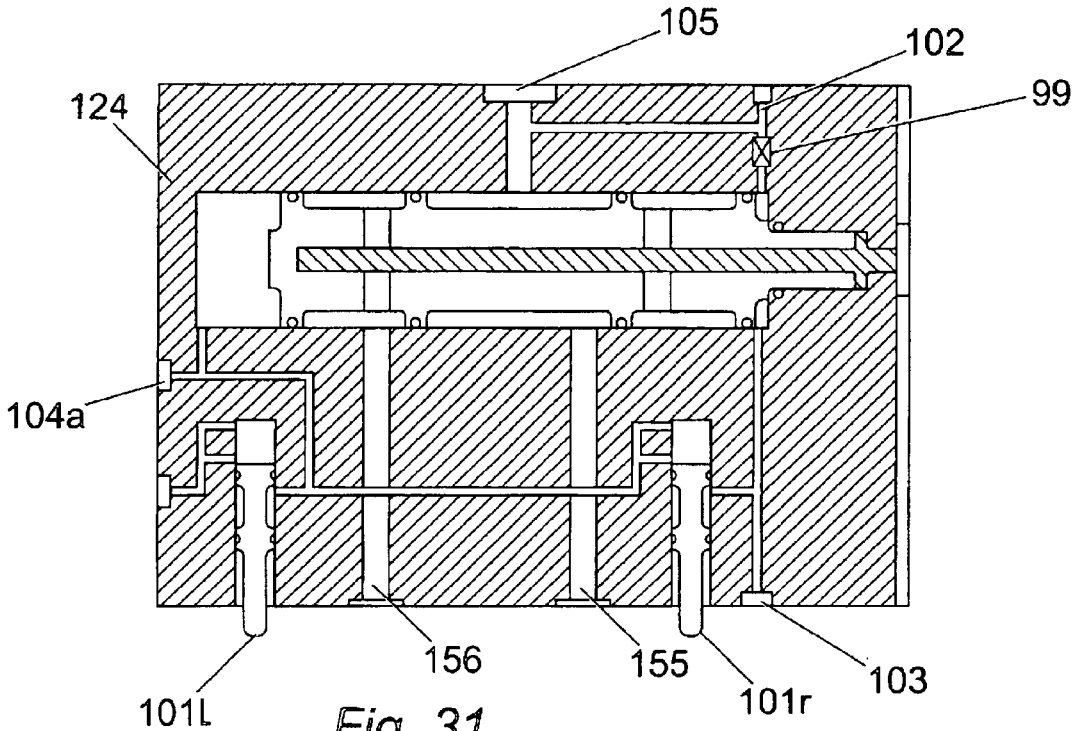

In a further embodiment shown in FIG. 31, a low pressure plug 99 is provided to allow low pressure only to pass to the piston through the air hole 155, whilst higher pressure (which is needed to operate the spool 108) can still be fed to each end of the spool 108 from the pilot port 103.

Figure 32:
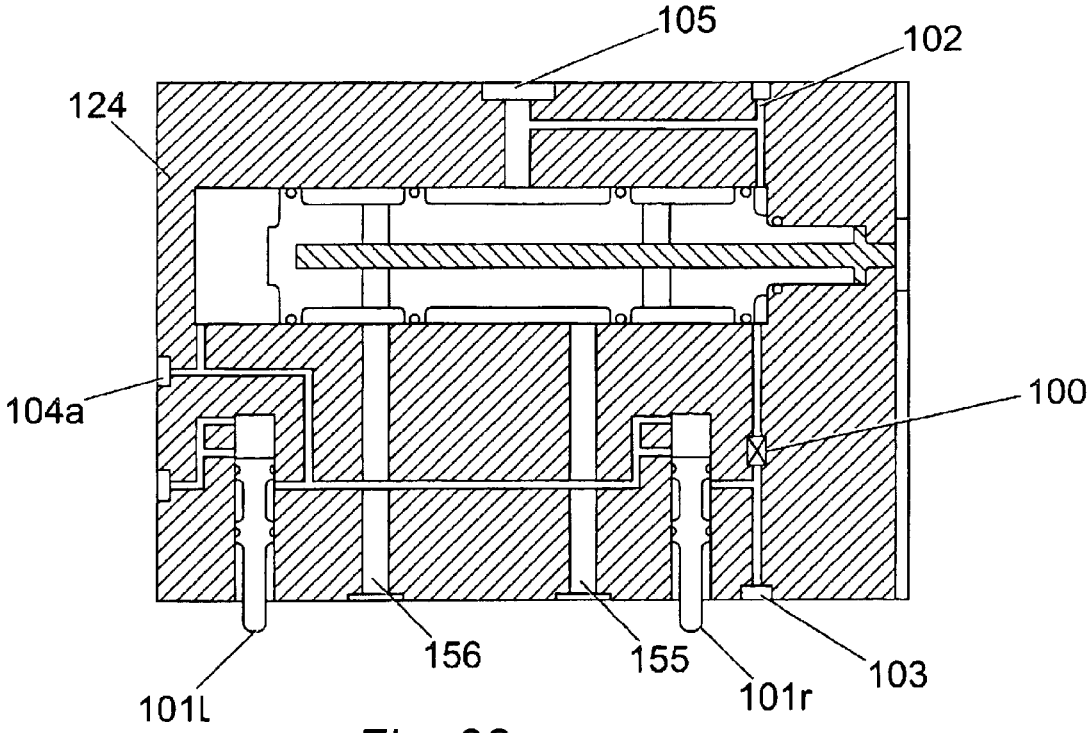

FIG. 32 shows a further embodiment in which the remote pilot port 103 is blanked off and the grub screw 100 cuts off drive air from the poppet valves 101*r*, 101*l* via the bleed lines. This disables the right hand poppet 101*r*, and a single short burst of air drives the air valve piston 122 (not shown) through a single cycle and then stops it until another pulse is applied. This can be used for metering applications.

Modifications and improvements can be incorporated without departing from the scope of the invention.

What is claimed is:

1. A pump comprising a reciprocating piston moved in a pistion chamber by pneumatic pressure, the pneumatic pressure being directed through channels by one or more valves, at least one of the valves and/or channels being located in a removable portion of the pump, the removable portion of the pump further comprising a pilot valve to control operation of the one or more valves.

2. A pump according to claim 1, wherein the removable portion of the pump houses all of the valves necessary for the direction of the airflow through the channels.

3. A pump according to claim 1 or claim 2, wherein the removable portion is in the form of a moulded block.

4. A pump according to claim 3, wherein the removable portion is moulded from plastics materials to define the chnnels and/or locations for valves in the moulded block.

5. A pump according to claim 1, wherein the removable portion is attached to the pump by one or more removable attachment members.

6. A pump according to claim 5, wherein the or each removable attachment member comprises a rod or a clip for cooperating with an indentation or a socket on the removable portion and/or the body of the pump.

7. A pump according to claim 5, wherein the ore each removable attachment member comprises a flexible rod that in the assembled pump engages in a channel formed between two aligned keyways of the removable portion and the body of the pump.

8. A pump as claimed in claim 7, wherein the channel is generally arcuate.

9. A pump as claimed in claim 1, wherein at least one of the valves is a shuttle valve or a poppet valve.

10. A pump as claimed in claim 1, having an exhaust cowling containing acoustic damping materials to quiet the pump exhaust.

11. A pump as claimed in claim 1, wherein an exhaust air from the pump is directed over the portion of the pump to balance temperature fluctuations in the pump.

12. A connector portion for attachment of a mating connector portion to a body, the connector portion having a bore being in fluid communication with a bore of the body and a bore of the mating connector portion, the connector portion being captive on the body but being rotatable thereon to enable connection of the connector portion to the mating connector portion without torque being applied to the body.

13. A connector portion as claimed in claim 12, wherein the body is formed of plastics material.

14. A connector portion as claimed in claim 12, wherein the connector portion is disposed on a flange of the body.

15. A connector portion as claimed in claim 12, comprising a socket for connection to a mating male portion.

16. A connector portion as claimed in claim 12, wherein the or each connector portion has screw threads to enable connection between mating portions.

17. A connector portion as claimed in claim 12, having an O-ring seal for sealing the connector portion to the housing.

* * * * *

UNITED STATES PATENT AND TRADEMARK OFFICE

CERTIFICATE OF CORRECTION

PATENT NO. : 6,736,612 B2
DATED : May 18, 2004
INVENTOR(S) : Gibbons

It is certified that error appears in the above-identified patent and that said Letters Patent is hereby corrected as shown below:

Title page,
Item [56], References Cited, U.S. PATENT DOCUMENTS, please delete "4,867,653 A * 9/1989 Miolls et al……417/360" and insert therefor -- 4,867,653 A * 9/1989 Mills et al……417/360 --.

Column 6,
Line 43, please delete "chnnels" and insert therefore -- channels --.

Signed and Sealed this

Twenty-seventh Day of July, 2004

JON W. DUDAS
*Acting Director of the United States Patent and Trademark Office*